US009869487B2

(12) United States Patent
Nickey et al.

(10) Patent No.: US 9,869,487 B2
(45) Date of Patent: Jan. 16, 2018

(54) HEAT EXCHANGER HAVING STACKED COIL SECTIONS

(75) Inventors: Glenn Eugene Nickey, New Oxford, PA (US); Ian Michael Casper, York, PA (US); William L. Kopko, Jacobus, PA (US); Michael Lee Buckley, Abbottstown, PA (US); Mustafa Kemal Yanik, York, PA (US)

(73) Assignee: Johnson Controls Technology Company, Milwaukee, WI (US)

( * ) Notice: Subject to any disclaimer, the term of this patent is extended or adjusted under 35 U.S.C. 154(b) by 1040 days.

(21) Appl. No.: 13/025,907

(22) Filed: Feb. 11, 2011

(65) Prior Publication Data

US 2011/0192188 A1 Aug. 11, 2011

Related U.S. Application Data

(63) Continuation of application No. PCT/US2011/023932, filed on Feb. 7, 2011.

(60) Provisional application No. 61/302,333, filed on Feb. 8, 2010.

(51) Int. Cl.

| | |
|---|---|
| ***F25B 39/04*** | (2006.01) |
| ***F24F 13/30*** | (2006.01) |
| ***F28B 1/06*** | (2006.01) |
| ***F28D 1/04*** | (2006.01) |

(52) U.S. Cl.

CPC ..... *F24F 13/30* (2013.01); *F28B 1/06* (2013.01); *F28D 1/0435* (2013.01)

(58) Field of Classification Search

USPC ..... 62/196.4, 197, 509, 510, 513

See application file for complete search history.

(56) References Cited

U.S. PATENT DOCUMENTS

| | | | | |
|---|---|---|---|---|
| 4,251,247 | A * | 2/1981 | Gauberthier et al. | 62/612 |
| 4,369,633 | A * | 1/1983 | Snyder | 62/117 |
| 5,207,074 | A | 5/1993 | Cox et al. | |
| 5,279,360 | A | 1/1994 | Hughes et al. | |
| 5,341,870 | A * | 8/1994 | Hughes et al. | 165/110 |
| 6,553,778 | B2 * | 4/2003 | Tipton et al. | 62/196.1 |
| 6,644,049 | B2 * | 11/2003 | Alford | 62/173 |
| 7,096,681 | B2 * | 8/2006 | Wills et al. | 62/175 |
| 7,434,415 | B2 * | 10/2008 | Knight et al. | 62/173 |
| 2002/0092318 | A1 * | 7/2002 | Tipton et al. | 62/510 |
| 2004/0089015 | A1 | 5/2004 | Knight et al. | |

(Continued)

FOREIGN PATENT DOCUMENTS

| | | |
|---|---|---|
| EP | 0027604 A2 | 4/1981 |
| EP | 2051037 A1 | 4/2009 |

(Continued)

OTHER PUBLICATIONS

English Translation of JP Office Action, Feb. 9, 2015, 3 pages.

(Continued)

*Primary Examiner* — Elizabeth Martin

(74) *Attorney, Agent, or Firm* — Fletcher Yoder, P.C.

(57) ABSTRACT

A heat exchanger is provided with stacked coil sections. Each of the stacked coil sections is configured to circulate a fluid independent from the other coil section. An air moving device is used to circulate air through both of the stacked coil sections. The stacked coil sections are positioned to have the air exiting the one coil section entering the other coil section.

20 Claims, 14 Drawing Sheets

(56) References Cited

U.S. PATENT DOCUMENTS

| | | | | |
|---|---|---|---|---|
| 2005/0103048 | A1* | 5/2005 | Kim et al. | 62/510 |
| 2005/0155375 | A1* | 7/2005 | Wensink et al. | 62/510 |
| 2005/0188708 | A1 | 9/2005 | Wills et al. | |
| 2006/0201188 | A1* | 9/2006 | Kopko | 62/333 |
| 2009/0025405 | A1* | 1/2009 | Yanik | 62/117 |
| 2009/0025914 | A1 | 1/2009 | Knight et al. | |
| 2009/0301411 | A1 | 12/2009 | Iwasaki | |

FOREIGN PATENT DOCUMENTS

| | | | |
|---|---|---|---|
| JP | S58-024764 | A | 2/1983 |
| JP | H11264621 | A | 9/1999 |
| JP | 2002081886 | | 3/2002 |
| JP | 2007139278 | A | 6/2007 |
| JP | 2007183077 | A | 7/2007 |
| JP | 2007198693 | A | 8/2007 |
| JP | 2008209083 | | 9/2008 |
| WO | 9964794 | A1 | 12/1999 |
| WO | 2008130359 | A1 | 10/2008 |
| WO | 2008150289 | A1 | 12/2008 |
| WO | 2010008960 | A2 | 1/2010 |

OTHER PUBLICATIONS

English Translation of CN Office Action, Feb. 10, 2015, 21 pages.
Korean Office Action for KR Application No. 10-2016-7004023 Mailed Nov. 15, 2016; 4 Pages.
Korean Office Action received Jan. 2015, 18 pages.
Korean Notice of Allowance for KR Application No. 10-2016-7004023 dated May 26, 2017; 3 Pages.
Japanese Office Action for JP Application No. 2015-125439 dated Mar. 28, 2017; 3 Pages.

* cited by examiner

HEAT EXCHANGER HAVING STACKED COIL SECTIONS

CROSS-REFERENCE TO RELATED APPLICATIONS

This application is a continuation of International Application No. PCT/US2011/023932, entitled "HEAT EXCHANGER HAVING STACKED COIL SECTIONS," filed on Feb. 7, 2011, which claims priority from and the benefit of U.S. Provisional Application No. 61/302,333, entitled "HEAT EXCHANGER," filed Feb. 8, 2010, both of which applications are hereby incorporated by reference in their entirety.

BACKGROUND

The application generally relates to a heat exchanger. The application relates more specifically to an air-cooled condenser for a heating, ventilation, air conditioning and refrigeration (HVAC&R) system having stacked coil sections operating at different condensing temperatures and/or pressures.

In HVAC&R systems, a refrigerant gas is compressed by a compressor and then delivered to the condenser. The refrigerant vapor delivered to the condenser enters into a heat exchange relationship with a fluid, e.g., air or water, and undergoes a phase change to a refrigerant liquid. The liquid refrigerant from the condenser flows through a corresponding expansion device(s) to an evaporator. The liquid refrigerant in the evaporator enters into a heat exchange relationship with another fluid, e.g. air, water or other process fluid, and undergoes a phase change to a refrigerant vapor. The other fluid flowing through the evaporator is chilled or cooled as a result of the heat-exchange relationship with the refrigerant and can then be used to cool an enclosed space. Finally, the vapor refrigerant in the evaporator returns to the compressor to complete the cycle.

In an air-cooled condenser, the refrigerant flowing through the condenser can exchange heat with circulating air generated by an air moving device such as a fan or blower. Since circulating air is used for heat exchange in an air-cooled condenser, the performance and efficiency of the condenser, and ultimately the HVAC&R system, is subject to the ambient temperature of the air that is being circulated through the condenser. As the ambient air temperature increases, the condensing temperature (and pressure) of the refrigerant in the condenser also increases. At very high ambient air temperatures, i.e., air temperatures greater than 110 degrees Fahrenheit (° F.), the performance and efficiency of the HVAC&R system can decrease due to higher condensing temperatures (and pressures) caused by the very high ambient air temperatures.

Therefore, what is needed is an air-cooled condenser that can operate at a lower condensing temperature at very high ambient air temperatures to maintain desired HVAC&R system performance and efficiency.

SUMMARY

The present application is directed to a heat exchanger having at least one first section configured to circulate a fluid and at least one second section configured to circulate a fluid. The fluid flow in the at least one second section is separate from the fluid flow in the at least one first section. The heat exchanger includes at least one air moving device to circulate air through both the at least one first section and the at least one second section. The at least one first section is positioned next to and substantially parallel to the at least one second section and the at least one first section and the at least one second section are positioned to have the air exiting the at least one first section entering the at least one second section.

The present application is additionally directed to a vapor compression system having a first circuit to circulate a refrigerant with a first compressor, first condenser and first evaporator in fluid communication and a second circuit to circulate a refrigerant with a second compressor, second condenser and second evaporator in fluid communication. The vapor compression system also includes at least one air moving device to circulate air through both the first condenser and the second condenser. The first condenser and the second condenser each have at least one substantially planar section. The at least one substantially planar section of the first condenser being positioned next to and substantially parallel to the at least one substantially planar section of the second condenser. The condensing temperature of the refrigerant in the first condenser is different from a condensing temperature of the refrigerant in the second condenser.

One advantage of the present application is a more compact system design in terms of footprint and/or volume when compared to systems of similar capacity.

Another advantage of the present application is increased system capacity at very high ambient air temperatures.

Still another advantage of the present application is the ability to equalize compressor motor loads when using economizers.

A further advantage of the present application is the ability to use fewer fans to circulate air through the condenser which results in lower fan noise associated with the condenser.

Yet a further advantage of the present application is more efficient use of the condenser surface by more closely correlating ambient air temperature and condensing temperature.

Other advantages of the present application include lower cost, improved system efficiency and a lighter weight unit.

DETAILED DESCRIPTION OF THE EXEMPLARY EMBODIMENTS

Figure 1:
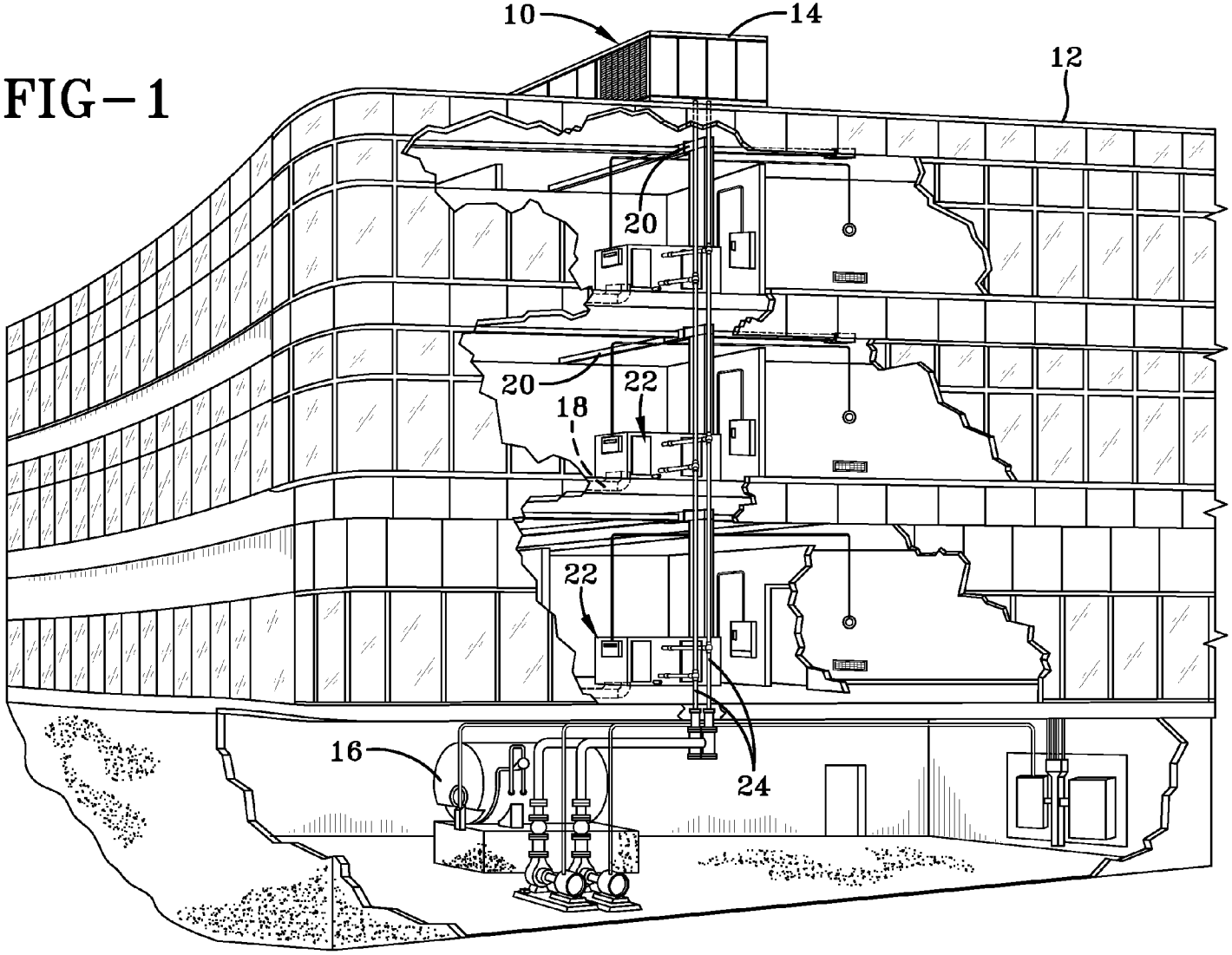
FIG. 1 shows an exemplary embodiment for a heating, ventilation, air conditioning and refrigeration system.

Referring to FIG. 1, an exemplary environment for a heating, ventilation, air conditioning and refrigeration (HVAC&R) system 10 in a building 12 for a typical commercial setting is shown. HVAC&R system 10 may include a compressor incorporated into a rooftop unit 14 that may supply a chilled liquid that may be used to cool building 12. HVAC&R system 10 may also include a boiler 16 to supply a heated liquid that may be used to heat building 12, and an air distribution system that circulates air through building 12. The air distribution system may include an air return duct 18, an air supply duct 20 and an air handler 22. Air handler 22 may include a heat exchanger (not shown) that is connected to boiler 16 and rooftop unit 14 by conduits 24. The heat exchanger (not shown) in air handler 22 may receive either heated liquid from boiler 16 or chilled liquid from rooftop unit 14 depending on the mode of operation of HVAC&R system 10. HVAC&R system 10 is shown with a separate air handler 22 on each floor of building 12. However, several air handlers 22 may service more than one floor, or one air handler may service all of the floors.

HVAC&R system 10 can include an air-cooled condenser for the exchange of heat with the refrigerant used in HVAC&R system 10. To more efficiently use the heat transfer surface of an air-cooled condenser in HVAC&R system 10, the refrigerant temperature in the condenser can be correlated or matched to the temperature of the air circulating through the condenser. In one exemplary embodiment, the air-cooled heat exchanger or condenser can be set up, configured or arranged to have one or more portions with substantially planar sections or coils arranged or positioned in a V-shape. The sections or coils can be stacked or nested and operated at different condensing temperatures, condensing pressure and/or in different refrigerant circuits. The stacked sections or coils can be arranged or positioned so that the air exiting one section or coil enters the other section or coil. Stated differently, the air flow through the sections or coils of the portion of the condenser can be in a series configuration or arrangement. In another exemplary embodiment, the condenser may have portions with both stacked sections and coils operating at different condensing temperatures or pressures and single sections or coils operating at a single condensing temperature or pressure.

Figure 2:
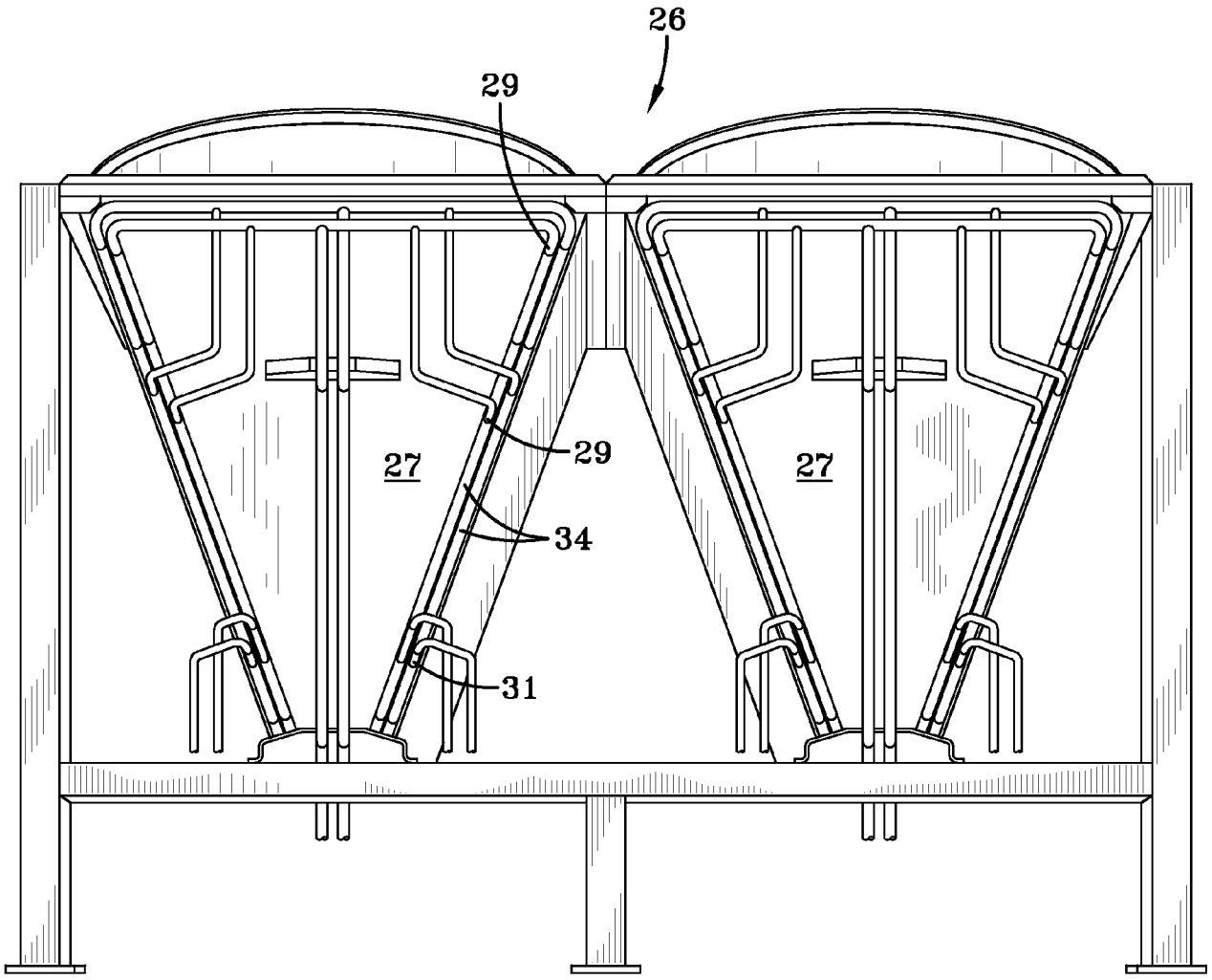
FIG. 2 shows a side view of an exemplary embodiment of a heat exchanger.

FIG. 2 shows an exemplary embodiment of a condenser. In the exemplary embodiment of FIG. 2, condenser 26 can have portions 27 having separate, stacked sections or coils 34. The outer sections or coils (of the V-shape) of heat exchanger or condenser portion 27 can be part of one refrigerant circuit and the inner sections or coils (of the V-shape) of heat exchanger or condenser portion 27 can be part of a second refrigerant circuit. The discharge vapor or gas from the compressor(s) can enter each section or coil 34 at connections 29 at the top and middle of the section or coil 34. The liquid refrigerant can exit each section or coil 34 from a connection 31 near the bottom of the section or coil 34. In one exemplary embodiment, each section or coil 34 can be identical in design, configuration or arrangement with two refrigerant passes through the section or coil 34. However, in other exemplary embodiments, the sections or coils can have different designs, sizes or configurations and a different number of passes of refrigerant. The use of a section or coil 34 with two passes results in both inlet and outlet connections being at the same end of the section or coil 34 and can provide for the cooler air leaving a subcooling portion of the upstream section or coil to be used by a subcooling portion of the downstream section or coil.

In another exemplary embodiment, a single pass or odd-number pass configuration may be used for each section or coil 34 or particular sections or coils 34. The single pass or odd-number pass configuration can result in the corresponding refrigerant headers for the section or coil 34 being at opposite ends of the section or coil 34 to provide sufficient space for the easy assembly and assembly of the piping connections.

Figure 3:
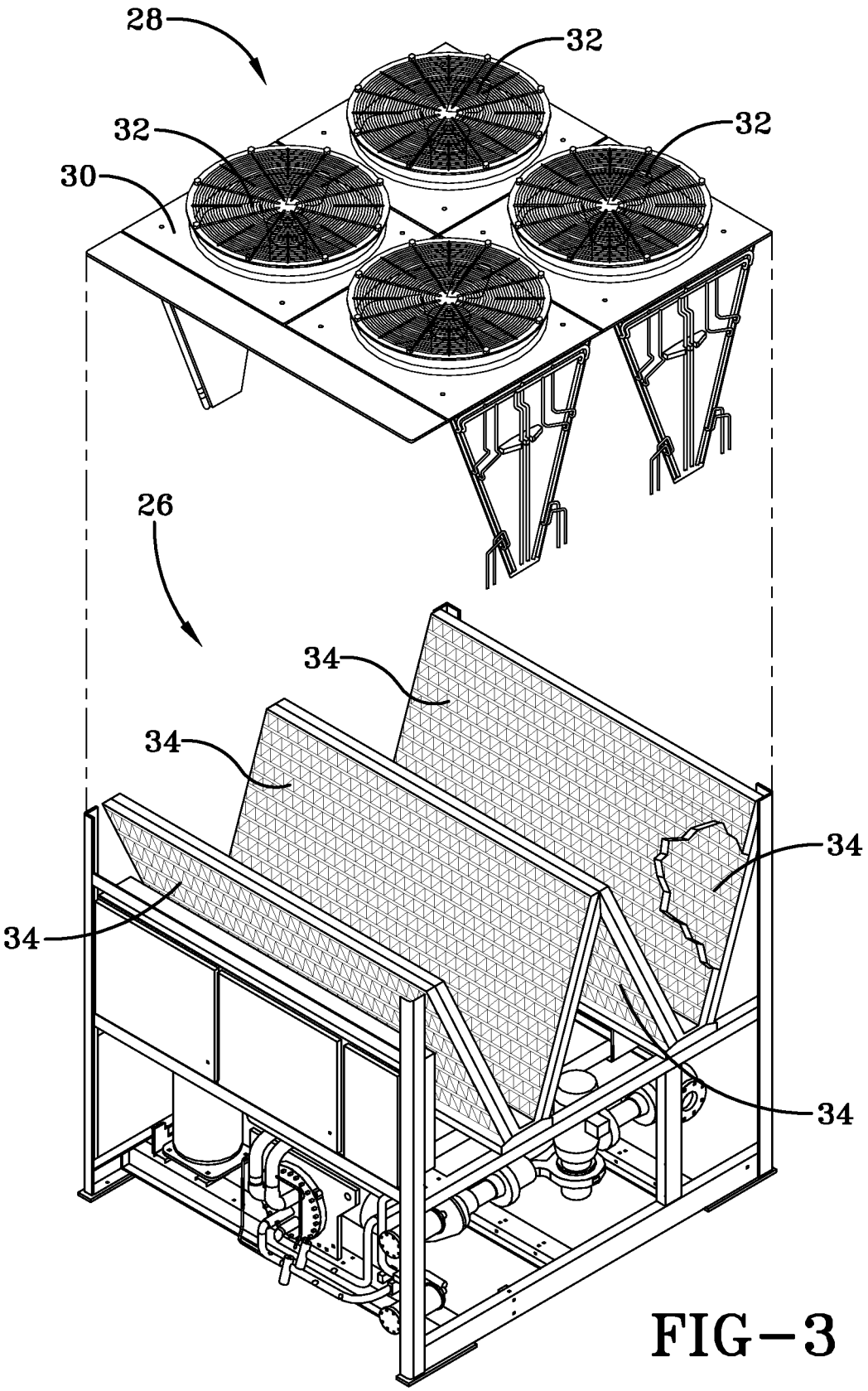
FIG. 3 shows a partially exploded view of an exemplary embodiment of a heat exchanger.

FIG. 3 shows a partially exploded view of a heat exchanger or condenser 26 that may be used in the exemplary HVAC&R system 10 shown in FIG. 1. Heat exchanger 26 may include an upper assembly 28 including a shroud 30 and one or more fans 32. The heat exchanger sections or coils 34 may be positioned beneath shroud 30 and may be positioned above or at least partially above other HVAC&R system components, such as a compressor(s), an expansion device, or an evaporator. The heat exchanger sections or coils 34 can be mounted using the same or common structural components and can be assembled as part of a packaged unit. Section or coils 34 may be positioned at any angle between zero degrees and ninety degrees to provide enhanced airflow through coils 34 and to assist with the drainage of liquid from coils 34. In one exemplary embodiment, the stacking of the heat exchanger sections or coils as part of a packaged unit provides for a compact unit that can be shipped in standard shipping containers.

Figure 4B:
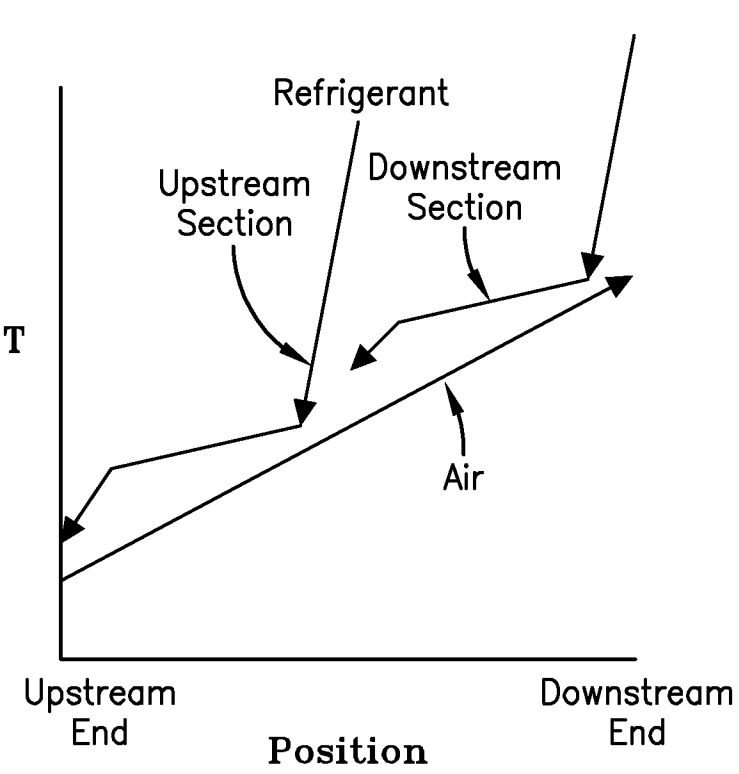
FIGS. 4A and 4B are graphs of refrigerant temperature relative to air temperature for different condenser configurations.
Figure 4A:
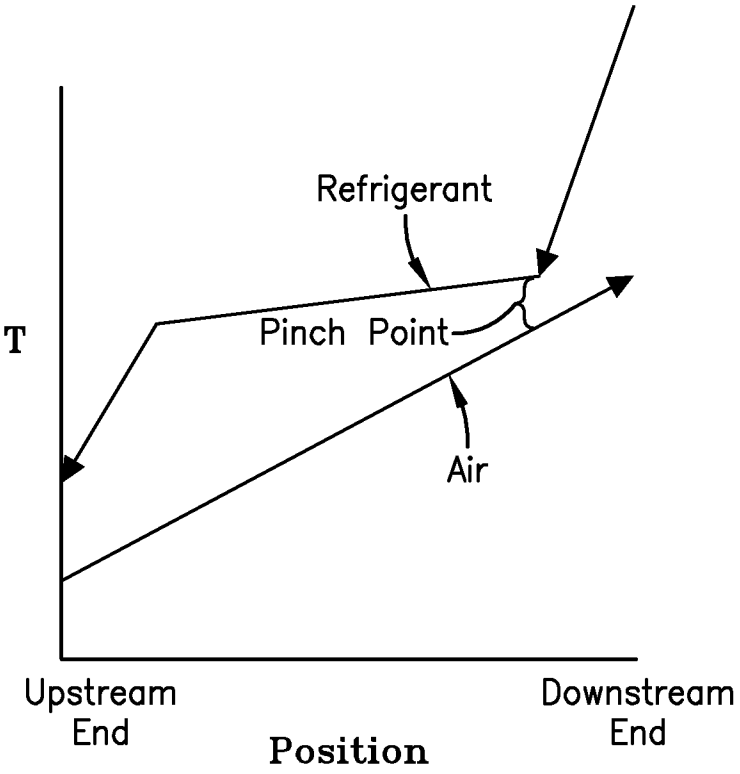

FIGS. 4A and 4B show the contrast in condenser refrigerant temperature between a single condenser section configuration and a stacked condenser section configuration. FIG. 4A shows condenser refrigerant temperature relative to air temperature for a single condenser section or coil configuration. A pinch point, as shown in FIG. 4A, between the leaving air temperature and the refrigerant temperature limits the condensing temperature of the refrigerant. Increasing condenser heat transfer surface area can provide little or no improvement in theoretical condensing temperature because the refrigerant temperature is limited by the leaving air temperature at the pinch point. In addition, the extra air-side pressure drop from the added heat transfer surface area can reduce air flow and can eventually result in a higher condensing temperature. Thus, there is a practical limit to the amount of heat transfer that can be obtained from a single coil or section for a given fan.

In contrast, FIG. 4B, shows condenser refrigerant temperature relative to air temperature for a stacked condenser section or coil configuration used with two refrigerant circuits and having series air flow. The upstream refrigerant circuit (and condenser section) has half the heat transfer load and thus sees a lower leaving air temperature, which permits the use of a much lower condensing temperature. The downstream refrigerant circuit (and condenser section) perform about the same as the single condenser section shown in FIG. 4A. The downstream refrigerant circuit or section in FIG. 4B can have a higher entering refrigerant temperature, but the leaving refrigerant temperature is almost unchanged (relative to FIG. 4A), moreover, the downstream refrigerant circuit or section has half the heat transfer load. The result of using the two refrigerant circuits or condenser sections is a large reduction in the average condensing temperature for the two refrigerant circuits or condenser sections. The series air flow configuration for the stacked condenser sections can effectively reduce the thermodynamic limit to the condensing temperature because the heat exchange better approximates a counter-flow arrangement.

In one exemplary embodiment, the sections or coils 34 can be implemented with microchannel or multichannel coils or heat exchangers. Microchannel or multichannel coils can have the advantage of compact size, light weight, low air-side pressure drop, and low material cost. The microchannel or multichannel coils or sections can circulate refrigerant through two or more tube sections, each of which has two more tubes, passageways or channels for the flow of refrigerant. The tube section can have a cross-sectional shape in the form or a rectangle, parallelogram, trapezoid, ellipse, oval or other similar geometric shape. The tubes in the tube section can have a cross-sectional shape in the form of a rectangle, square, circle, oval, ellipse, triangle, trapezoid, parallelogram or other suitable geometric shape. In one embodiment, the tubes in the tube section can have a size, e.g., width or diameter, of between about a half (0.5) millimeter (mm) to about a three (3) millimeters (mm). In another embodiment, the tubes in the tube section can have a size, e.g., width or diameter, of about one (1) millimeter (mm).

In another exemplary embodiment, the sections or coils 34 can be implemented with round-tube plate-fin coils. One exemplary configuration for round-tube plate-fin coils is to split the fins so that there is no conduction path between the two refrigerant circuits or coils, but to use a common tube sheet. The result is two separate coils from a thermal standpoint, but mechanically they appear as single unit. Another exemplary configuration is to make a round-tube coil where the refrigerant circuits share the fins. However, there may be conduction through the fins between the two circuits or coils that may be limited by the inclusion of a thermal break (such as a slit) in the fin design. In still another exemplary embodiment, the round-tube coil condensers can be configured to have the desuperheating sections downstream of both condensing sections and the subcooling sections upstream of both condensing sections to provide the optimum thermal performance.

FIGS. 5-12 show different exemplary embodiments of vapor compression systems for HVAC&R system 10 that incorporate or use a stacked condenser sections or coils. The vapor compression systems can circulate a refrigerant through one or more independent or separate circuits starting with compressors 42 and including a condenser 26 having stacked sections or coils, expansion device(s) 46, and an evaporator or liquid chiller 48. The vapor compression systems can also include a control panel that can include an analog to digital (A/D) converter, a microprocessor, a non-volatile memory, and an interface board. Some examples of fluids that may be used as refrigerants in the vapor compression systems are hydrofluorocarbon (HFC) based refrigerants, for example, R-410A, R-407, R-134a, hydrofluoro olefin (HFO), "natural" refrigerants like ammonia ($NH_3$), R-717, carbon dioxide ($CO_2$), R-744, or hydrocarbon based refrigerants, water vapor or any other suitable type of refrigerant. In one exemplary embodiment, the same refrigerant can be circulated in all of the circuit in the vapor compression system. However, in other embodiments, different refrigerants can be circulated in separate refrigerant circuits.

Compressors 42 can have a fixed Vi (volume ratio or volume index), i.e., the ratio of suction volume to discharge volume, or the compressors 42 can have a variable Vi. In addition, compressors 42 for each circuit may have the same Vi or the Vi for the compressors 42 may be different. The motors used with compressors 42 can be powered by a variable speed drive (VSD) or can be powered directly from an alternating current (AC) or direct current (DC) power source. The VSD, if used, receives AC power having a particular fixed line voltage and fixed line frequency from the AC power source and provides power to the motor having a variable voltage and frequency. The motor can include any type of electric motor that can be powered by a VSD or directly from an AC or DC power source. The motor can be any other suitable motor type, for example, a switched reluctance motor, an induction motor, or an electronically commutated permanent magnet motor. The output capacity of compressors 42 may be based upon the corresponding operating speeds of compressors 42, which operating speeds are dependent on the output speed of the motor driven by the VSD. In an another exemplary embodiment, other drive mechanisms such as steam or gas turbines or engines and associated components can be used to drive the compressors 42.

Compressors 42 compress a refrigerant vapor and deliver the compressed vapor to the separate condenser sections or coils of condenser 26 through separate discharge passages. Condenser 26 can have an upstream section or coil 80 and a downstream section or coil 82 relative to the direction of air flow through the condenser. The upstream section or coil 80 can operate at lower condenser temperatures and pressures relative to the downstream section or coil 82. The refrigerant vapor delivered by compressors 42 to upstream section or coil 80 and downstream section or coil 82 transfers heat to air circulated by fan(s) 32. The refrigerant vapor condenses to a refrigerant liquid in both upstream section or coil 80 and downstream section or coil 82 as a result of the heat transfer with the air. In addition, upstream section or coil 80 and downstream section or coil 82 may also include a sub-cooler for the liquid refrigerant. The liquid refrigerant from upstream section or coil 80 and downstream section or coil 82 flows through expansion device(s) 46 to evaporator 48. The liquid refrigerant delivered to evaporator 48 absorbs heat from a process fluid, e.g., water, air, ethylene glycol, calcium chloride brine, sodium chloride brine or other suitable type of fluid, to chill or lower the temperature of the process fluid and undergoes a phase change to a refrigerant vapor. The vapor refrigerant exits evaporator 48 and returns to compressors 42 by suction lines to complete the circuit or cycle. Depending on the number of circuits implemented in a particular vapor compression system, evaporator 48 may have one or more vessels. Further, even if multiple circuits are used for a particular vapor compression system, the evaporator may still use a single vessel that can maintain the separate refrigerant circuits for heat transfer.

In one exemplary embodiment, compressors 42 can be selected to not have the same Vi. In other words, one compressor 42 can have a high Vi (relative to the other compressor) and the other compressor 42 can have a low Vi (relative to the other compressor). The low Vi compressor can be connected to the upstream section or coil 80 having the lower condensing temperature. As shown in FIG. 4B, the temperature of the air for the downstream condenser section or coil 82 is greater than the temperature of the air for the upstream condenser section or coil 80. Thus, the difference in airflow temperature permits the refrigerant from the high Vi compressor to condense in the downstream condenser section or coil 82 at a higher condensing temperature and/or pressure than the refrigerant from the low Vi compressor in the upstream condenser section or coil 80. Using the low Vi compressor with the upstream condenser section or coil 80 operating at the lower condensing temperature can improve full-load efficiency for the vapor compression system. In addition, part-load efficiency of the vapor compression system can be improved when only the low Vi compressor is operated. In one particular exemplary embodiment, the low Vi compressor can be a centrifugal compressor and the high Vi compressor can be a positive displacement compressor such as a screw compressor.

In one particular exemplary embodiment, the compressor for the refrigerant circuit with the upstream coil can be a variable-speed centrifugal compressor and the high Vi compressor with the downstream coil can be a positive displacement compressor such as a screw compressor. The compressor pairing in this embodiment improves the high-ambient temperature capability of the system since the compressor configuration reduces the discharge pressures required on the centrifugal compressor. The discharge pressure that a centrifugal compressor can achieve is generally limited by a maximum ratio of compressor suction and discharge pressures for given compressor design. The centrifugal compressor can be a hermetic two-stage compressor with variable-speed direct-drive and magnetic bearings. High part-load efficiency for the system can be obtained by operating the centrifugal compressor by itself, i.e., the screw compressor is not operated, at part-load conditions.

Figure 5:
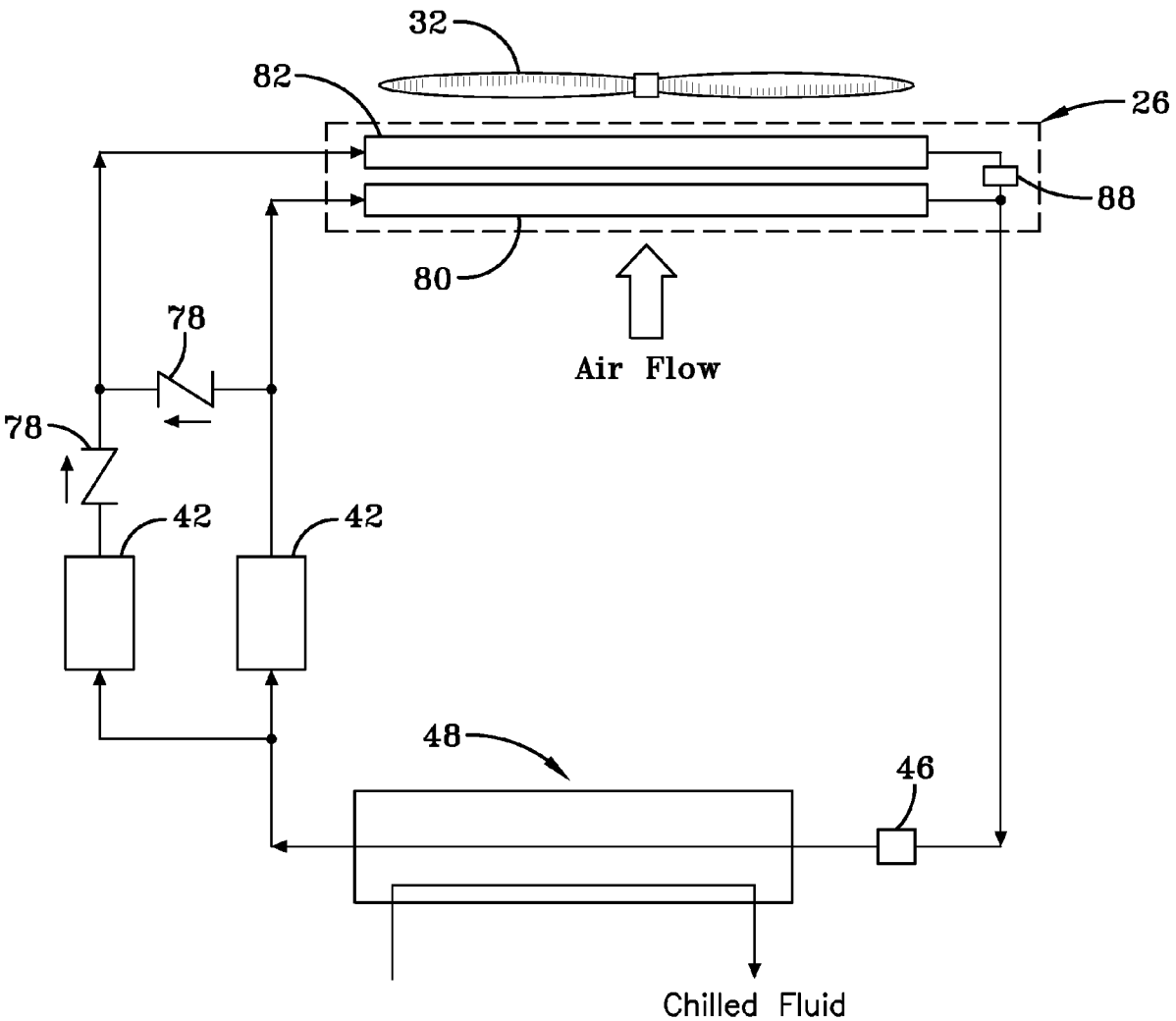
FIGS. 5 through 12 schematically show different exemplary embodiments of vapor compression systems with a condenser or heat exchanger having stacked sections or coils.

FIG. 5 shows a vapor compression system with multiple compressors supplying a single refrigerant circuit. The vapor compression system of FIG. 5 uses check valves 78 or other similar valves to isolate refrigerant flow so that only a single compressor may be operated. In addition, an orifice 88 is used at the output of the condenser 26 to equalize the pressure of the refrigerants exiting the upstream section or coil 80 and downstream section or coil 82. The working pressure of the refrigerant line between condenser 26 and expansion device 46 can be lower than what the working pressure would be if a separate connection was used for the downstream section or coil 82. The lower working pressure enables additional components in the liquid line between condenser 26 and expansion device 46, for example, a filter/drier or sight glass, to be configured and operated for lower pressures. The compressors used for the separate refrigerant circuits may have the same Vi or different Vi. In an exemplary embodiment of the vapor compression system of FIG. 5, compressors 42 can be scroll compressors.

Figure 6:
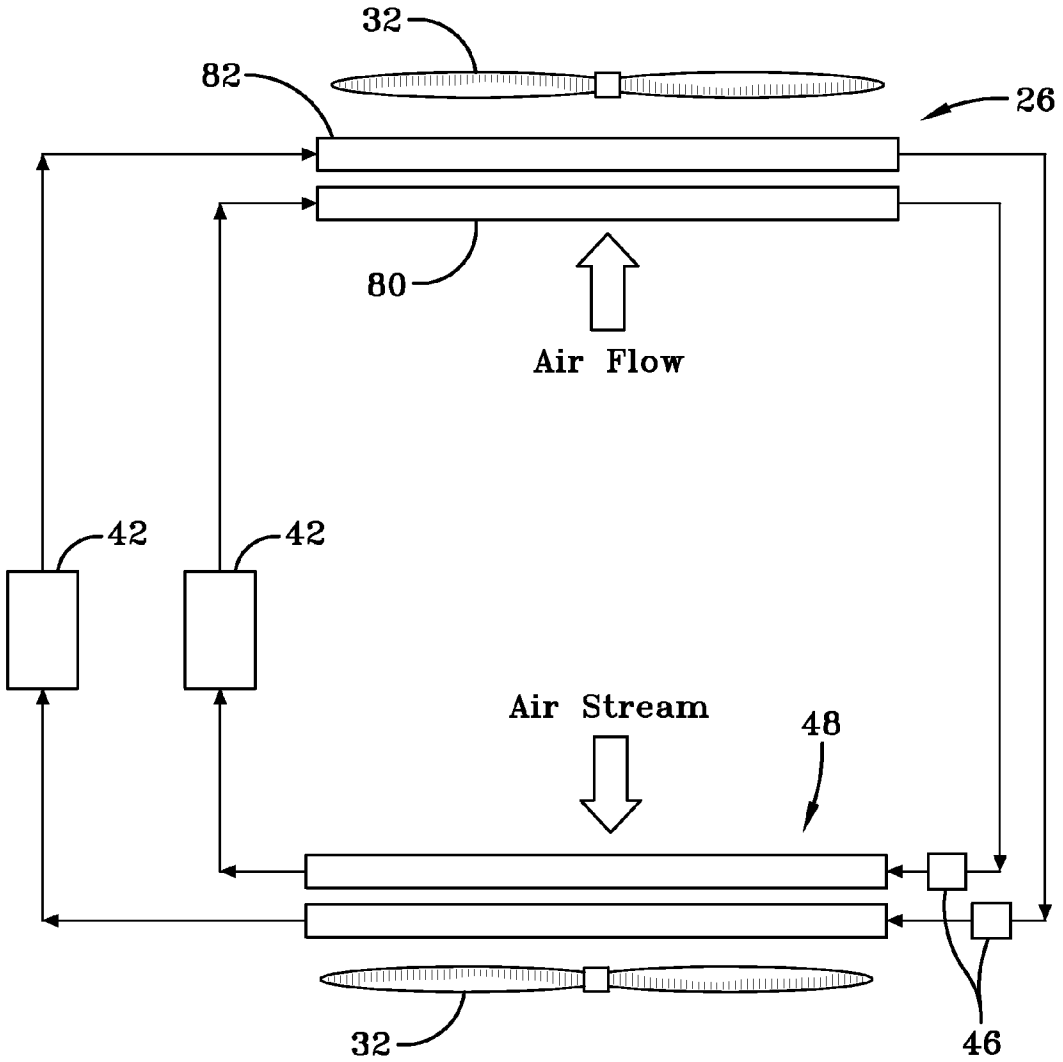

FIG. 6 shows a vapor compression system with multiple separate refrigerant circuits and separate evaporator sections for each circuit that are used to cool air directly for the HVAC&R system 10. The compressors used for the separate refrigerant circuits may have the same Vi or different Vi. In an exemplary embodiment of the vapor compression system of FIG. 6, the vapor compression system can be used in a packaged rooftop unit.

Figure 7:
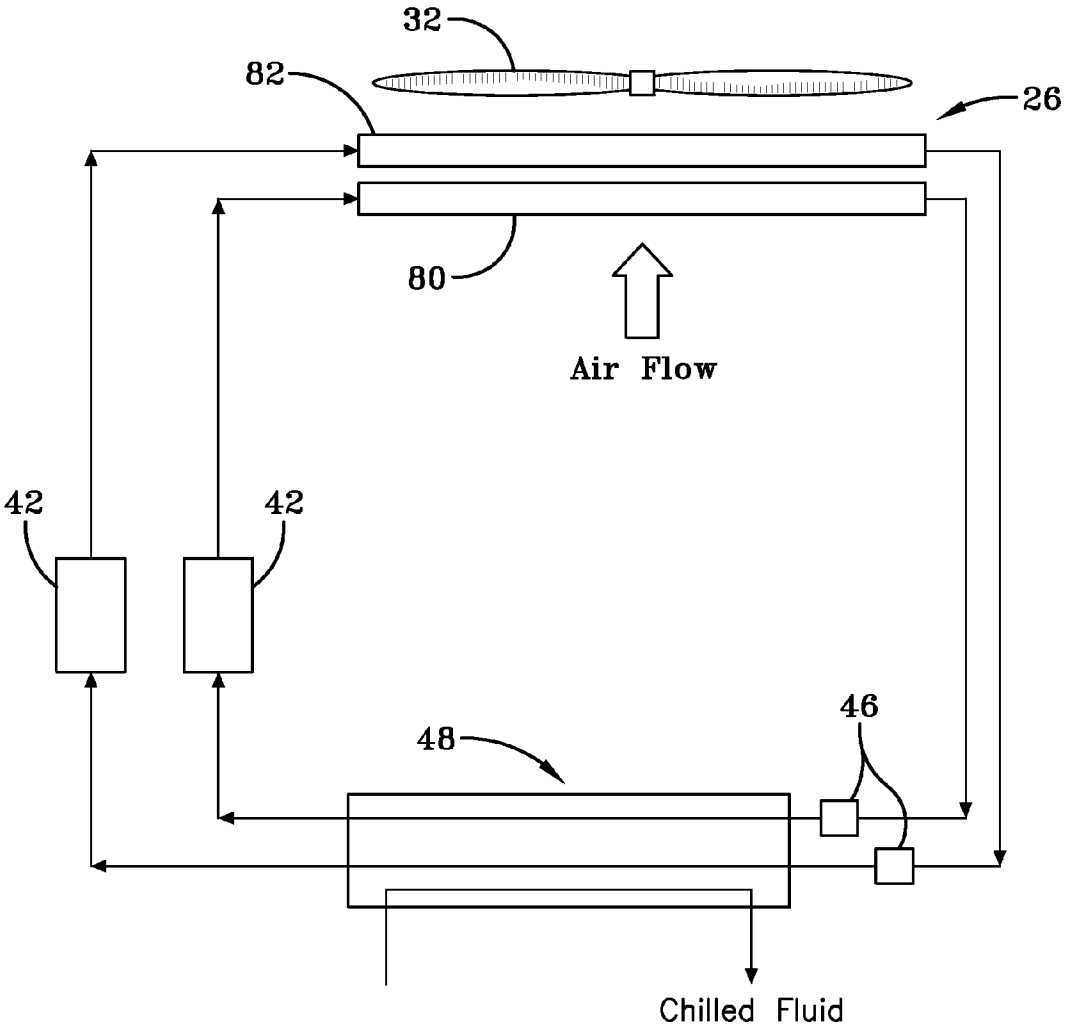

FIG. 7 shows a vapor compression system with multiple separate refrigerant circuits using a single evaporator vessel. The compressors used for the separate refrigerant circuits may have the same Vi or may have a different Vi. In an exemplary embodiment of the vapor compression system of FIG. 7, the vapor compression system can be used for chillers or chilled liquid systems and incorporate scroll compressors.

In the exemplary embodiments shown in FIGS. 8-12, the vapor compression circuits can include one or more intermediate or economizer circuits incorporated between condenser 26 and expansion devices 46. The intermediate or economizer circuits can be utilized to provide increased cooling capacity for a given evaporator size and can increase efficiency and performance of the vapor compression system. The intermediate circuits can have an inlet line(s) that can be either connected directly to or can be in fluid communication with one or both of upstream section or coil 80 and downstream section or coil 82. The inlet line(s) can include an expansion device(s) 66 positioned upstream of an intermediate vessel. Expansion device 66 operates to lower the pressure of the refrigerant from the upstream section or coil 80 and/or downstream section or coil 82 to an intermediate pressure, resulting in the flashing of some of the refrigerant to a vapor. The flashed refrigerant at an intermediate pressure can be reintroduced into the corresponding compressor 42 for that particular circuit. Since intermediate pressure refrigerant vapor is returned to compressor 42, the refrigerant vapor requires less compression, thereby increasing overall efficiency for the vapor compression system. The remaining liquid refrigerant, at the intermediate pressure, from expansion device 66 is at a lower enthalpy which can facilitate heat transfer. Expansion devices 46 can receive the intermediate pressure refrigerant from the intermediate vessel and expand the lower enthalpy liquid refrigerant to evaporator pressure. The refrigerant enters the evaporator 48 with lower enthalpy, thereby increasing the cooling effect in systems with economizing circuits versus non-economized systems in which the refrigerant is expanded directly from the condenser.

The intermediate vessel can be a flash tank 70, also referred to as a flash intercooler, or the intermediate vessel can be configured as a heat exchanger 71, also referred to as a "surface economizer." Flash tank 70 may be used to separate the vapor from the liquid received from expansion device 66 and may also permit further expansion of the liquid. The vapor may be drawn by compressor 42 from flash tank 70 through an auxiliary refrigerant line to the suction inlet, a port at a pressure intermediate between suction and discharge or an intermediate stage of compression. In one exemplary embodiment, a solenoid valve 75 can be positioned in the auxiliary refrigerant line between the compressor 42 and flash tank 70 to regulate flow of refrigerant from the flash tank 70 to the compressor 42. The liquid that collects in the flash tank 70 is at a lower enthalpy from the expansion process. The liquid from flash tank 70 flows to the expansion device 46 and then to evaporator 48. Heat exchanger 71 can be used to transfer heat between refrigerants at two different pressures. The exchange of heat between the refrigerants in heat exchanger 71 can be used to subcool one of the refrigerants in heat exchanger 71 and at least partially evaporate the other refrigerant in heat exchanger 71.

Figure 8:
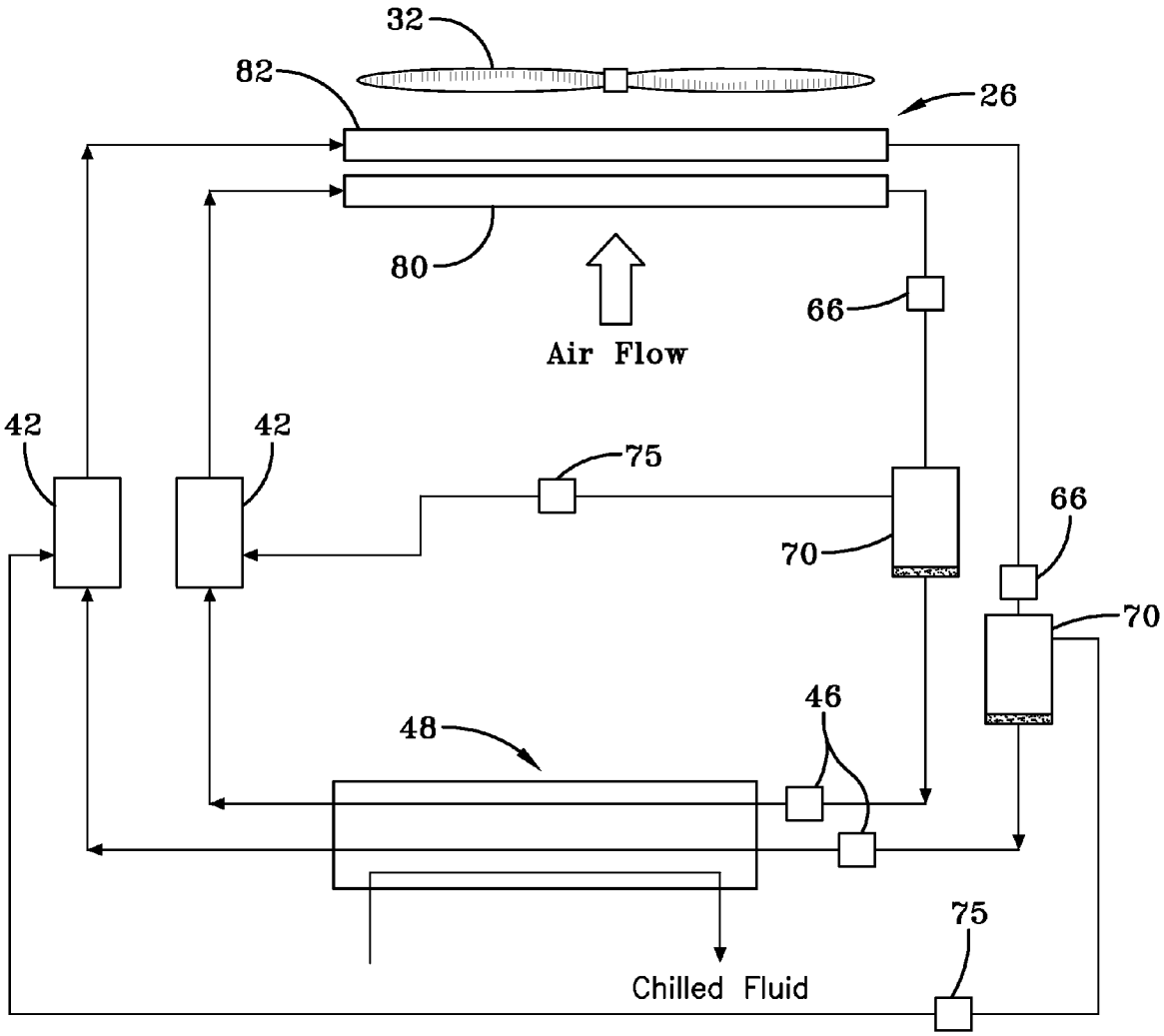

FIG. 8 shows a vapor compression system with multiple separate refrigerant circuits each incorporating an intermediate or economizer circuit. Each of the upstream section or coil 80 and downstream section or coil 82 can be fluidly connected to an expansion device 66 that is fluidly connected to a flash tank 70. The expansion devices 66 can be used to adjust the operating pressure of the economizers. The compressors used for the separate refrigerant circuits may have the same Vi or different Vi. In an exemplary embodiment using a high Vi compressor connected to the downstream section or coil 82 and a low Vi compressor connected to the upstream section or coil 80, the vapor refrigerant from the flash tank 70 connected to the downstream section or coil 82 can be provided to the high Vi compressor at a higher pressure to reduce motor loading on the high Vi compressor.

Figure 9:
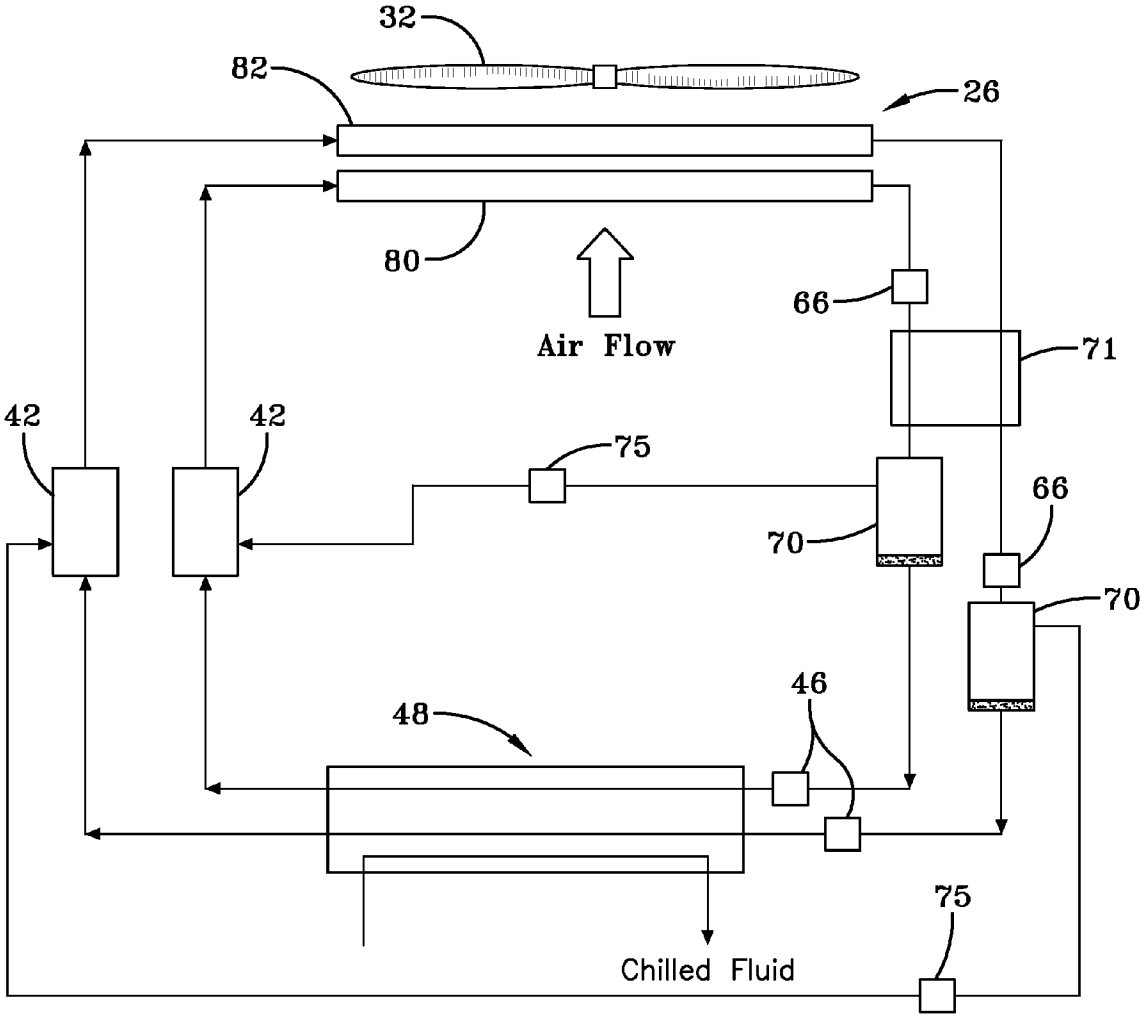

FIG. 9 shows a vapor compression system similar to the vapor compression system of FIG. 8 except that a heat exchanger is incorporated into the intermediate or economizer circuits. The upstream section or coil 80 can be fluidly connected to expansion device 66 that is fluidly connected heat exchanger 71 and then flash tank 70. The downstream section or coil 82 can be fluidly connected to heat exchanger 71 that is fluidly connected to expansion device 66 and then flash tank 70. The compressors used for the separate refrigerant circuits may have the same Vi or different Vi.

Figure 10:
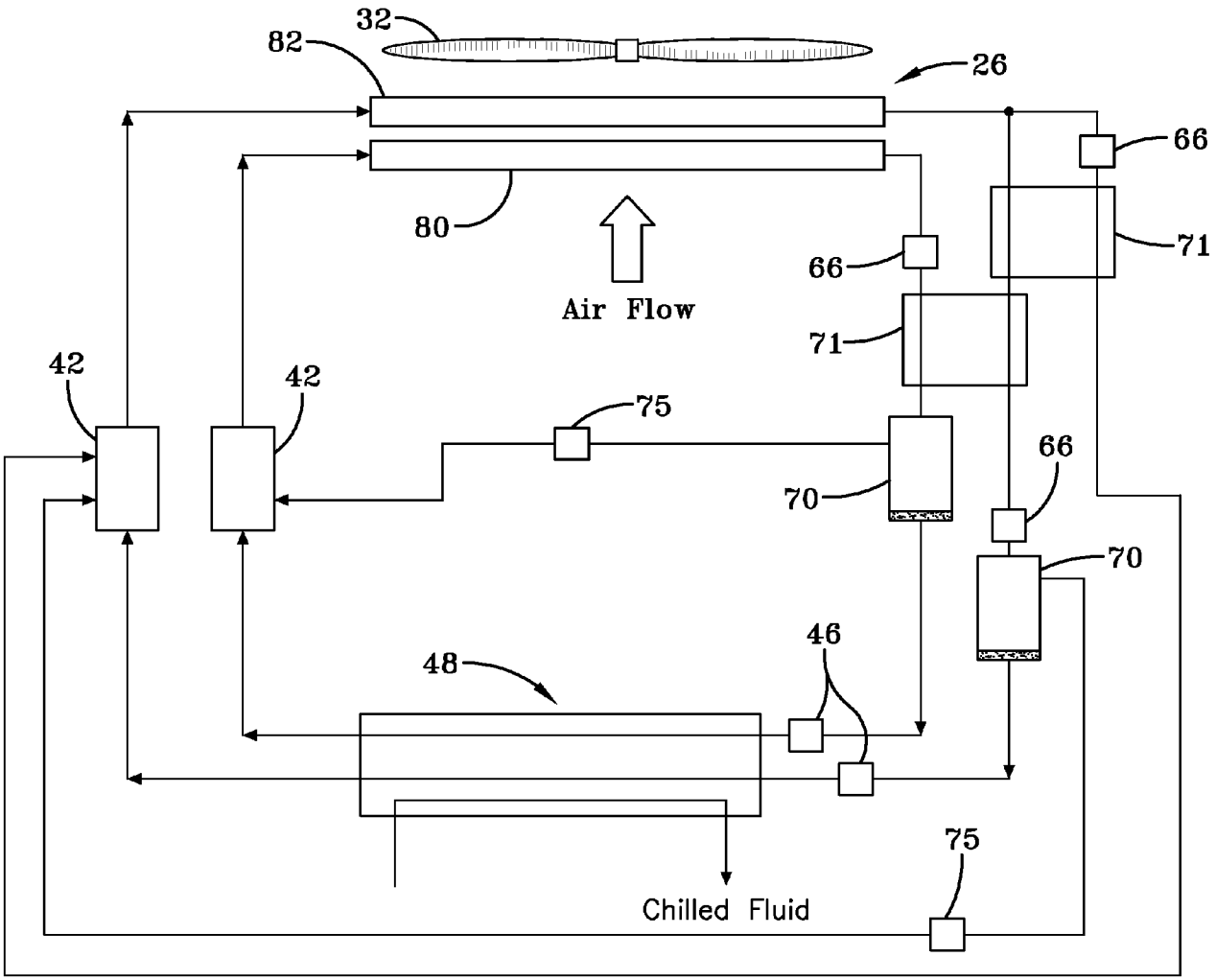

FIG. 10 shows a vapor compression system similar to the vapor compression system of FIG. 9 except that an additional or second heat exchanger is incorporated into the intermediate or economizer circuit connected to the downstream section or coil 82. The liquid refrigerant from the downstream section or coil 82 is split into two separate passageways and provided to a second heat exchanger 71. One of the passageways can incorporate an expansion device 66 before the liquid refrigerant enters the second heat exchanger 71. The output of the second heat exchanger 71 corresponding to the input passageway with the expansion device 66 can be provided to the compressor 42 supplying the downstream section or coil 82 at a port corresponding to a higher pressure in compressor 42 separate from the port connected to flash tank 70. The other output from second heat exchanger 71 can enter the first heat exchanger as described in FIG. 9. The compressors used for the separate refrigerant circuits may have the same Vi or different Vi.

Figure 11:
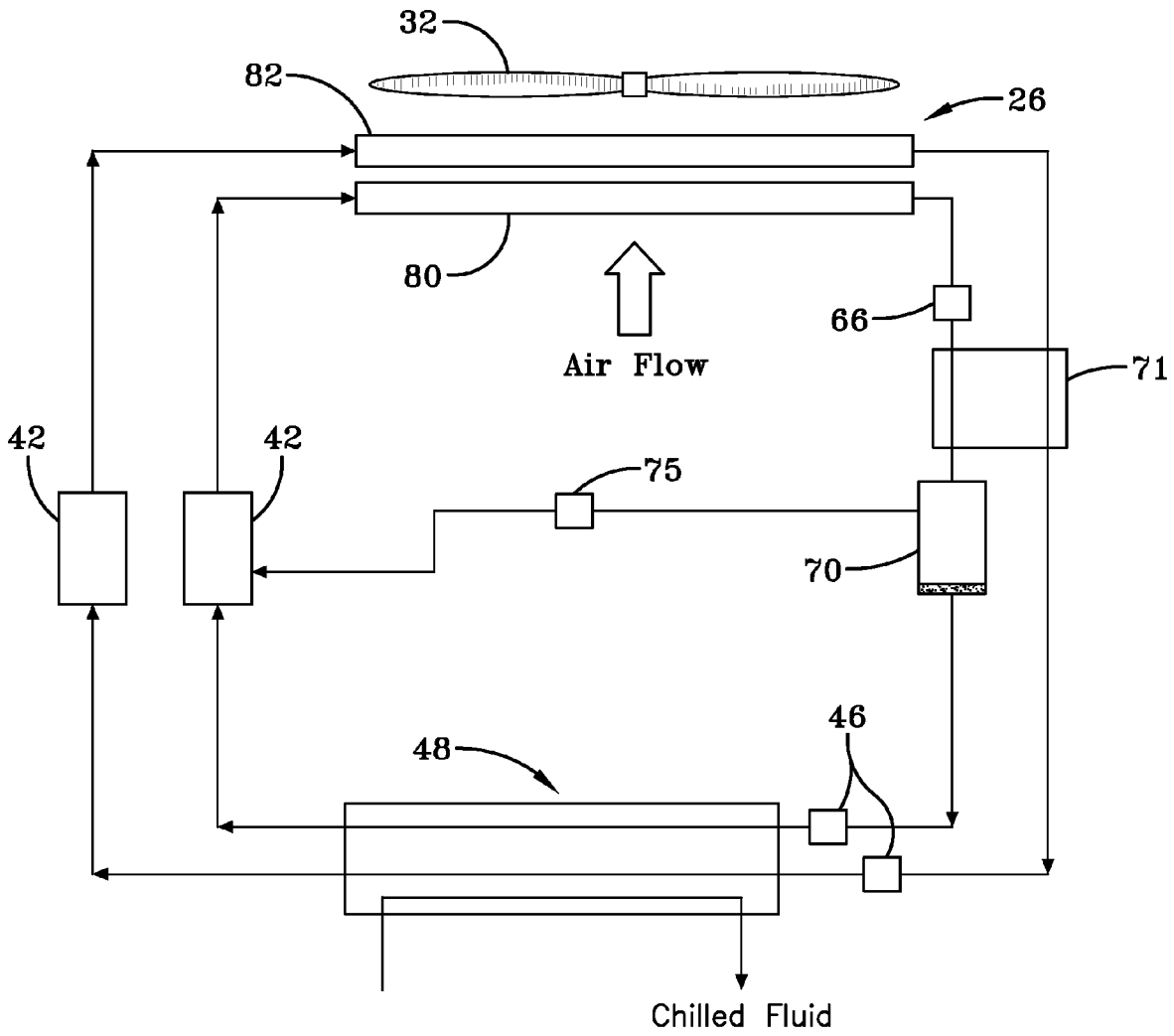

FIG. 11 shows a vapor compression system with multiple separate refrigerant circuits each incorporating an intermediate or economizer circuit. The upstream section or coil 80 can be fluidly connected to expansion device 66 that is fluidly connected heat exchanger 71 and then flash tank 70. The downstream section or coil 82 can be fluidly connected to heat exchanger 71 that is fluidly connected to expansion device 46 and then evaporator 48. The compressors used for the separate refrigerant circuits may have the same Vi or different Vi. Heat exchanger 71 can use the refrigerant from the upstream section or coil 80 to cool the refrigerant liquid from for the downstream section or coil 82. By cooling the refrigerant liquid from the downstream section or coil 82, the motor load on the compressor 42 connected to the downstream section or coil 82 can be reduced and equalized with the motor load on the compressor 42 connected to the upstream section or coil 80.

Figure 12:
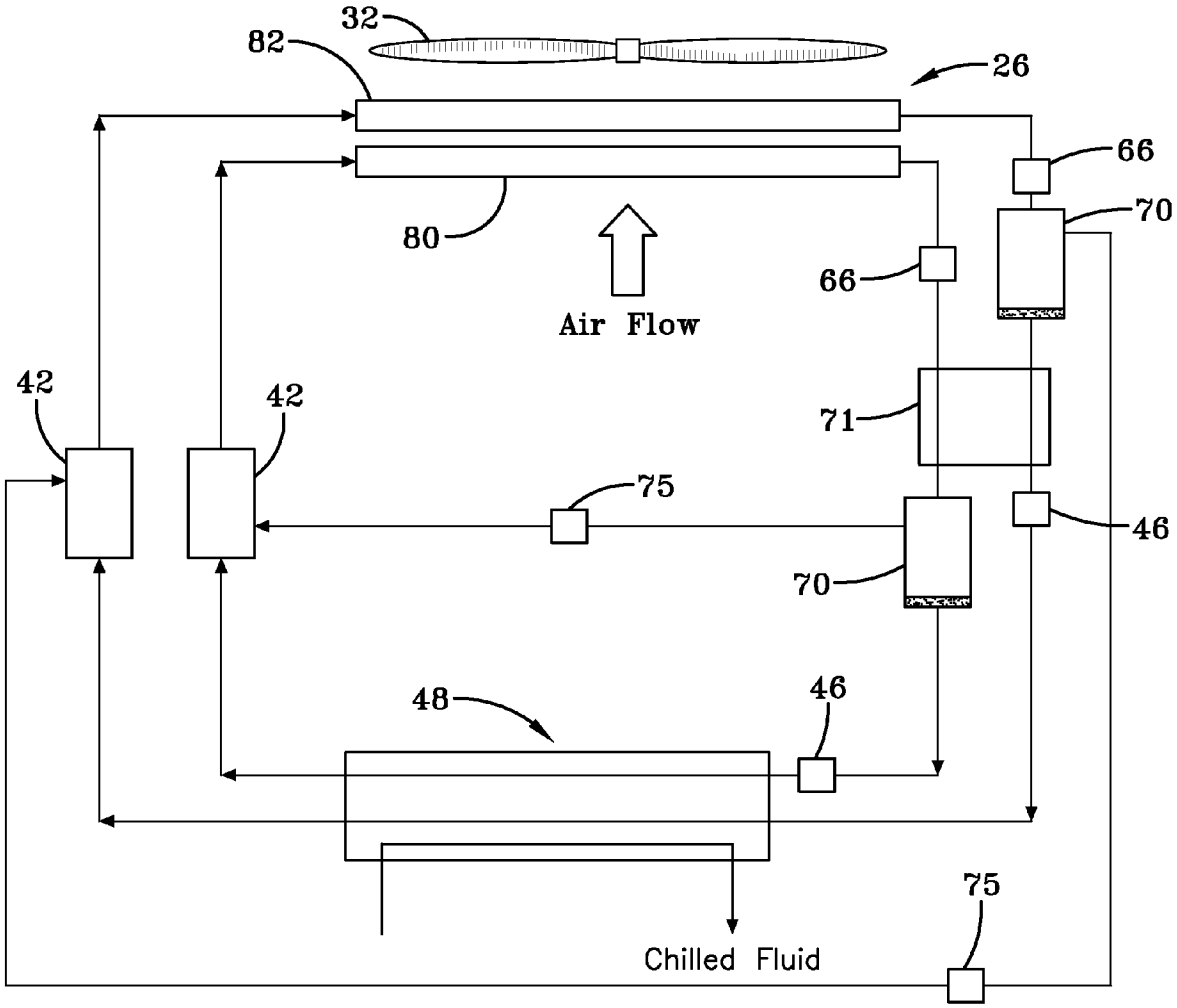

FIG. 12 shows a vapor compression system similar to the vapor compression system of FIG. 11 except that an additional flash tank is incorporated into the intermediate or economizer circuit connected to the downstream section or coil 82. The liquid refrigerant from the downstream section or coil 82 is fluidly connected to an expansion device 66 that is fluidly connected to a flash tank 70. The liquid refrigerant from flash tank 70 can be provided to heat exchanger 71 as described with respect to FIG. 11. The vapor refrigerant from flash tank 70 can be provided to the compressor 42 supplying the downstream section or coil 82. The compressors used for the separate refrigerant circuits may have the same Vi or different Vi.

In one exemplary embodiment using high and low Vi compressors, economizer load can be shifted from the circuit with the high Vi compressor operating at the higher condenser pressure to the circuit with the low Vi compressor operating at the lower condenser pressure to equalize compressor loading and improve capacity at high ambient temperatures.

Figure 13:
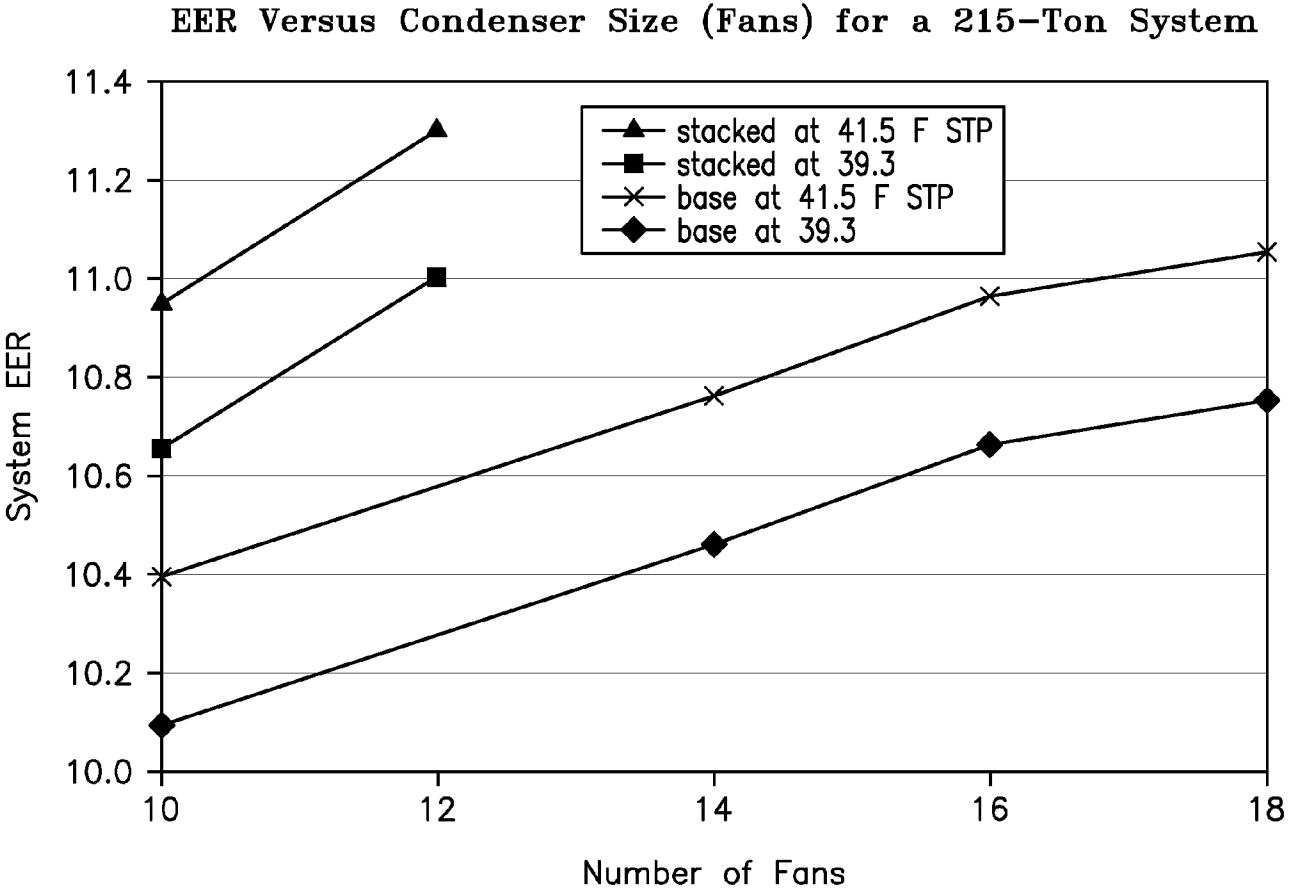
FIG. 13 is a graph of system efficiency relative to the number condenser fans for different system configurations.
Figure 14:
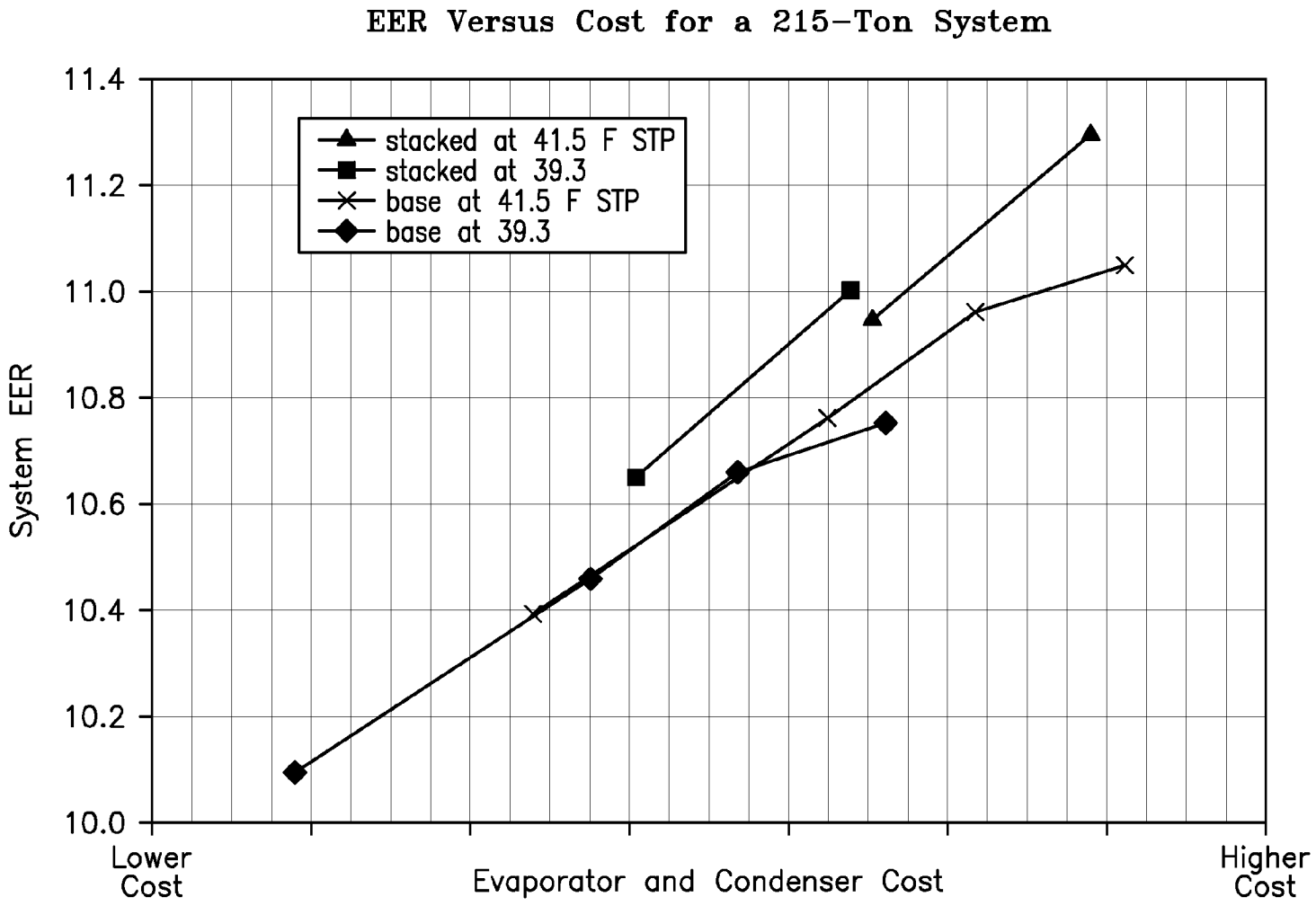
FIG. 14 is a graph of system efficiency relative to heat exchanger cost for different system configurations.

FIG. 13 compares system efficiency with the stacked condenser coil configuration to the system efficiency with a single condenser coil configuration. Both condenser coil configurations use 25 mm deep microchannel heat exchanger coils. For the purpose of the analysis, a vapor compression system configured as shown in FIG. 8 was used. In addition, both compressors have the same Vi design, i.e., a high Vi design. As shown in FIG. 13, about the same system efficiency can be obtained using only 10 fans with the stacked condenser coil configuration as can be obtained using 16 fans with the single condenser coil configuration, which can result in an improvement of about 9% in system efficiency. In addition, higher efficiency levels can be achieved over the single condenser coil configuration with the use of additional fans. FIG. 14 shows the relationship between system efficiency and system cost. The results in FIG. 14 are based on the same system configurations as in FIG. 13. As shown in FIG. 14, more efficient systems can be obtained using the stacked condenser coil configuration for the same cost as single condenser coil configuration. Furthermore, the stacked condenser coil configuration can provide a reduction cost compared to a single condenser coil configuration for a particular design efficiency.

In an exemplary embodiment, the condenser can be expanded to have more than two condenser sections or coils operating at different pressures. In general, the incremental performance improvement is smaller with each additional section and condensing pressure.

In another exemplary embodiment, each of the compressors may be a single-stage compressor, such as a screw compressor, reciprocating compressor, centrifugal compressor, rotary compressor, swing link compressor, scroll compressor, turbine compressor, or any other suitable compressor, although any single-stage or multi-stage compressor can be used.

In a further exemplary embodiment, the expansion devices may be any suitable expansion device including expansion valves such as electronic expansion valves or thermal expansion valves, capillary tubes or orifices.

In another exemplary embodiment, each compressor can include tandem, trio, or other multiple-compressor configurations that share a single refrigerant circuit and act as a single compressor system. For example, scroll compressors can be configured in a multiple compressor configuration, i.e., two or more compressors can be connected in a single refrigerant circuit. In the scroll compressor example, capacity control can be achieved by staging compressors in the multiple compressor configuration. In addition, a multiple compressor configuration can include other associated components such as valves to regulate flow. In still another exemplary embodiment, compressors having different design Vi may also share the same refrigerant circuit.

In other exemplary embodiments, the vapor compression system may have other configurations. For example, additional economizers may be incorporated to the circuits to further improve efficiency. The optimum economizer configuration depends on the efficiency and capacity improvement relative to the cost.

While the exemplary embodiments illustrated in the figures and described herein are presently preferred, it should be understood that these embodiments are offered by way of example only. Other substitutions, modifications, changes and omissions may be made in the design, operating conditions and arrangement of the exemplary embodiments without departing from the scope of the present application. Accordingly, the present application is not limited to a particular embodiment, but extends to various modifications that nevertheless fall within the scope of the appended claims. It should also be understood that the phraseology and terminology employed herein is for the purpose of description only and should not be regarded as limiting.

Only certain features and embodiments of the invention have been shown and described in the application and many modifications and changes may occur to those skilled in the art (e.g., variations in sizes, dimensions, structures, shapes and proportions of the various elements, values of parameters, mounting arrangements, use of materials, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. It is, therefore, to be understood that the appended claims are intended to cover all such modifications and changes as fall within the true spirit of the invention. Furthermore, in an effort to provide a concise description of the exemplary embodiments, all features of an actual implementation may not have been described (i.e., those unrelated to the presently contemplated best mode of carrying out the invention, or those unrelated to enabling the claimed invention). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

What is claimed is:

1. A vapor compression system comprising:

a first circuit to circulate a first refrigerant comprising a first compressor, first condenser and first evaporator in fluid communication;

a second circuit to circulate a second refrigerant comprising a second compressor, second condenser and second evaporator in fluid communication;

the first evaporator and the second evaporator being configured and positioned to exchange heat from a single process fluid;

at least one air moving device to circulate air through the first condenser and then the second condenser;

the first condenser and the second condenser each comprising a plurality of sections, each section of the first condenser being positioned next to and substantially parallel to a corresponding section of the second condenser;

each section of the first condenser being thermally separate from the corresponding section of the second condenser; and a condensing temperature of the first refrigerant in the first condenser is less than a condensing temperature of the second refrigerant in the second condenser.

2. The system of claim 1 wherein the plurality of sections of the first condenser and the plurality of sections of the second condenser use common structural components and are assembled as part of a packaged unit.

3. The system of claim 1 wherein a condensing pressure of the first refrigerant in the first condenser is less than a condensing pressure of the second refrigerant in the second condenser.

4. The system of claim 3 wherein the first compressor and the second compressor have different volume ratios.

5. The system of claim 4 wherein the first compressor has a lower volume ratio than the second compressor.

6. The system of claim 1 wherein both the first evaporator and the second evaporator exchange heat with the single process fluid in a common vessel.

7. The system of claim 1 further comprising a first economizer configured to receive the first refrigerant from the first condenser and provide vapor first refrigerant to the first compressor and liquid first refrigerant to the first evaporator.

8. The system of claim 7 further comprising a second economizer configured to receive the second refrigerant from the second condenser and provide vapor second refrigerant to the second compressor and liquid second refrigerant to the second evaporator.

9. The system of claim 8 further comprising:

a third economizer comprising a first input to receive the first refrigerant from the first condenser, a first output to provide the first refrigerant to the first economizer, a second input to receive the second refrigerant from the second condenser and a second output to provide the second refrigerant to the second economizer; and the third economizer being configured to permit heat exchange between the first and second refrigerants in the first circuit and the second circuit.

10. The system of claim 9 further comprising a fourth economizer configured to receive the second refrigerant from the second condenser and provide the second refrigerant to the third economizer and the second compressor, the fourth economizer being configured to vaporize the second refrigerant provided to the second compressor.

11. The system of claim 10 wherein the second refrigerant provided to the second compressor from the fourth economizer enters the second compressor at a location separate from the second refrigerant provided to the second compressor from the second economizer.

12. The system of claim 7 further comprising a second economizer comprising a first input to receive the first refrigerant from the first condenser, a first output to provide the first refrigerant to the first economizer, a second input to receive the second refrigerant from the second condenser and a second output to provide the second refrigerant to the second evaporator.

13. The system of claim 12 further comprising a third economizer configured to receive the second refrigerant from the second condenser and provide vapor second refrigerant to the second compressor and liquid second refrigerant to the second economizer.

14. The system of claim 1 wherein the first refrigerant is identical to the second refrigerant.

15. The system of claim 1 wherein the plurality of sections of the first condenser and the second condenser each comprises two refrigerant passes through the section.

16. The system of claim 1 wherein the plurality of sections of the first condenser and the second condenser are identical.

17. The system of claim 1 wherein the first compressor and the second compressor have the same volume ratio.

18. The system of claim 1 wherein at least one section of the plurality of sections of the first condenser comprises a subcooler portion.

19. The system of claim 1 wherein at least one section of the plurality of sections of the second condenser comprises a subcooler portion.

20. The system of claim 1 wherein the first compressor and the second compressor are the same compressor type.

* * * * *